US007118349B2

(12) United States Patent
Oglesby

(10) Patent No.: US 7,118,349 B2
(45) Date of Patent: Oct. 10, 2006

(54) HIGH PRESSURE SLURRY PISTON PUMP

(76) Inventor: Kenneth Doyle Oglesby, 14795 Chanel La., Skiatook, OK (US) 74070

( * ) Notice: Subject to any disclaimer, the term of this patent is extended or adjusted under 35 U.S.C. 154(b) by 138 days.

(21) Appl. No.: 11/033,615

(22) Filed: Jan. 12, 2005

(65) Prior Publication Data

US 2005/0152787 A1 Jul. 14, 2005

Related U.S. Application Data

(60) Provisional application No. 60/535,859, filed on Jan. 12, 2004.

(51) Int. Cl.
*F04B 39/00* (2006.01)
*F04B 41/00* (2006.01)

(52) U.S. Cl. ..... 417/53; 417/430; 417/442; 417/900; 417/440

(58) Field of Classification Search ..... 417/440, 417/430, 442, 289, 900, 53
See application file for complete search history.

(56) References Cited

U.S. PATENT DOCUMENTS 3,104,619 A 9/1963 Swartkout
3,759,057 A * 9/1973 English et al. ..... 62/196.3
3,818,805 A 6/1974 Johansson
4,023,469 A 5/1977 Miller
4,157,057 A 6/1979 Bailey
4,476,771 A 10/1984 Kao
4,598,630 A 7/1986 Kao
4,691,620 A 9/1987 Kao
5,047,012 A * 9/1991 Leuschner et al. ..... 604/32
5,741,710 A * 4/1998 Ek ..... 436/73
6,290,475 B1 * 9/2001 Snow ..... 417/430

* cited by examiner

*Primary Examiner*—Charles G. Freay
(74) *Attorney, Agent, or Firm*—M.A. Ervin & Associates; Michael A. Ervin

(57) ABSTRACT

A high pressure slurry pump is described which automatically provides a clean fluid buffer around the intake and exhaust valves of the pump and in front of the pump piston in order to displace erosive slurry material and thus extend the life of the pump and improve pump efficiency.

20 Claims, 5 Drawing Sheets

HIGH PRESSURE SLURRY PISTON PUMP

CROSS-REFERENCE TO RELATED APPLICATIONS

This application claims the benefit of U.S. provisional Ser. No. 60/535,859, filed Jan. 12, 2004 by the present inventor.

TECHNICAL FIELD

This invention relates to the general field of slurry pumps, and more particularly to slurry pumps having improved designs to address problems common in slurry pumps.

BACKGROUND

The petroleum, chemical, and cement industries, among others, often require the transport of slurries (solid rich liquids) as part of their process handling. Particularly when these slurry pump systems must operate at higher pressures a number of design and maintenance issues arise. Some example pumps that can handle slurries are—piston (e.g., triplex), centrifugal, bladder, displacement pot and progressing cavity (eg. Moyno®) types. They are driven by hydraulic (pressure) and mechanical (mostly with a power transmission rod connected to a crankshaft) means. Any of these means can be powered by a number of prime mover types (electric motor, gasoline engine, natural gas engine, etc. . . . ). Only the piston pump and the displacement pot types can handle the higher pressure needs of industry. On a mechanical actuated piston pump, the rod goes to a crankshaft or another hydraulic piston motor. Another means of actuating the piston/plunger and thus the pump action is by hydraulic means—alternating pressure differentials from either side of the piston. In a hydraulic actuated piston pump, the differential pressure across the plunger/piston can be minimized although the piston cylinder and heads undergo high-pressure cycles.

The problem that arises is that slurries are very erosive of the pump internal parts, especially on valves, seats, piston, cylinders, pump heads and wherever the slurry flow pattern changes or the velocity is high, i.e., turbulence. As a valve closes the area remaining for flow decreases, the slurry velocity increases (if rate stays the same) increasing the erosive ability of the slurry. Rapid velocity or flow pattern changes, as through valves seats, also focus the rapid erosion wear of pump parts. A hardened steel valve closing onto a hardened steel seat with solids in between makes sealing difficult and results in damaged parts and lower efficiencies. The high velocities and rapid flow direction changes in a centrifugal pump, plus their inherent inefficiencies, makes centrifugal type pumps not the first choice for such high-pressure applications. Progressing cavity type pumps can handle the solids but cannot easily achieve the higher pressures desired due to the elastomer materials in the stator.

The DIAjet, a displacement pot type by BHR, is currently available. It pressurizes clean fluid with a pump (of any type, triplex is most common) that is then directed (in full or in part) into a pressure pot that contains a pre-mixed batch of slurry which is then displaced or discharged from the pot. Production or continuous slurry pumping is difficult with this type system, since pots have to be alternately restocked and resealed for use.

A number of investigators have tried to address the problems of abrasive materials plugging or eroding piston or piston seals. Examples of this can be found in U.S. Pat. No. 3,104,619 to Swartkout, U.S. Pat. No. 4,023,469 to Miller, U.S. Pat. No. 4,157,057 to Bailey, U.S. Pat. Nos. 4,691,620, 4,598,630, and 4,476,771 to Kao. These investigators have developed a number of variations of flushing techniques to operate in the immediate vicinity of piston rings and seals to keep them as free as possible of abrasive materials during operation.

The flushing techniques in the aforementioned references are useful in addressing the problems of abrasive materials and are one aspect of the instant invention to be described. Further improvements are needed however to keep the abrasive materials away from any contact with the seals and rings of pistons and, in addition, away from the intake and exhaust valves of the slurry pump during the times the valves are required to close and seal.

SUMMARY

The needs discussed above are addressed by the instant invention.

One aspect of the instant invention is a slurry pump assembly including at least an inlet chamber connected to a slurry supply; an intake valve, downstream of said inlet chamber, for admitting material into a piston cylinder; a control valve, connected to a clean fluid supply, configured to supply clean fluid into said inlet chamber; a piston in said piston cylinder for providing pressure; a means for driving said piston through an intake and exhaust stroke cycle; and an exhaust valve connected to said piston cylinder; for exhausting pressurized materials from said piston cylinder.

Another aspect of the instant invention is a slurry pump assembly including at least an inlet chamber connected to a slurry supply; an intake valve, downstream of the inlet chamber, for admitting material into a piston cylinder; a piston in the piston cylinder for providing pressure; a means for driving the piston through an intake and exhaust stroke cycle; an exhaust valve connected to the piston cylinder; for exhausting pressurized materials from the piston cylinder; and a control valve, connected to a clean fluid supply, configured to supply clean fluid into the immediate vicinity of intake valve and the exhaust valve.

Another aspect of the invention is a method to displace slurry material and place clean fluid across the intake and exhaust valves during the stroke cycles of a slurry piston pump assembly including at least the steps of: injecting a first specific volume of a clean fluid into the immediate vicinity of the intake and exhaust valves as a piston is initially withdrawn from a piston cylinder during a first portion of an intake stroke cycle, allowing clean fluid to buffer the intake and exhaust valves; flowing a slurry consisting of a solid material and a slurry carrier fluid through the intake valve and into the piston cylinder during a second portion of the intake stroke cycle; and injecting a second specific volume of clean fluid into the immediate vicinity of the intake and exhaust valves as the piston is withdrawn from the piston cylinder during a third and final portion of the intake stroke cycle, allowing clean fluid to buffer the intake and exhaust valves.

Another aspect of the instant invention is the use of internal channels in the piston with a check valve (ball or flapper) to flush clean fluid ahead of the piston during the intake stroke. This buffer of clean fluid between the piston and the slurry remains during the exhaust stroke cycle and help prevent wear on the piston cylinder seal.

Another aspect of the instant invention is the use of an internal helical pattern in the piston cylinder with matching pattern on the piston that forces internal movement/mixing of the slurry during each stroke segment and piston rotation for enhanced cleaning.

To insure that a clear and complete explanation is given to enable a person of ordinary skill in the art to practice the invention specific examples will be given involving applying the invention to a specific configuration of a high pressure slurry pump. It should be understood though that the inventive concept could apply to various modifications of such high pressure slurry pump systems and the specific examples are not intended to limit the inventive concept to the example application.

DETAILED DESCRIPTION

Figure 1:
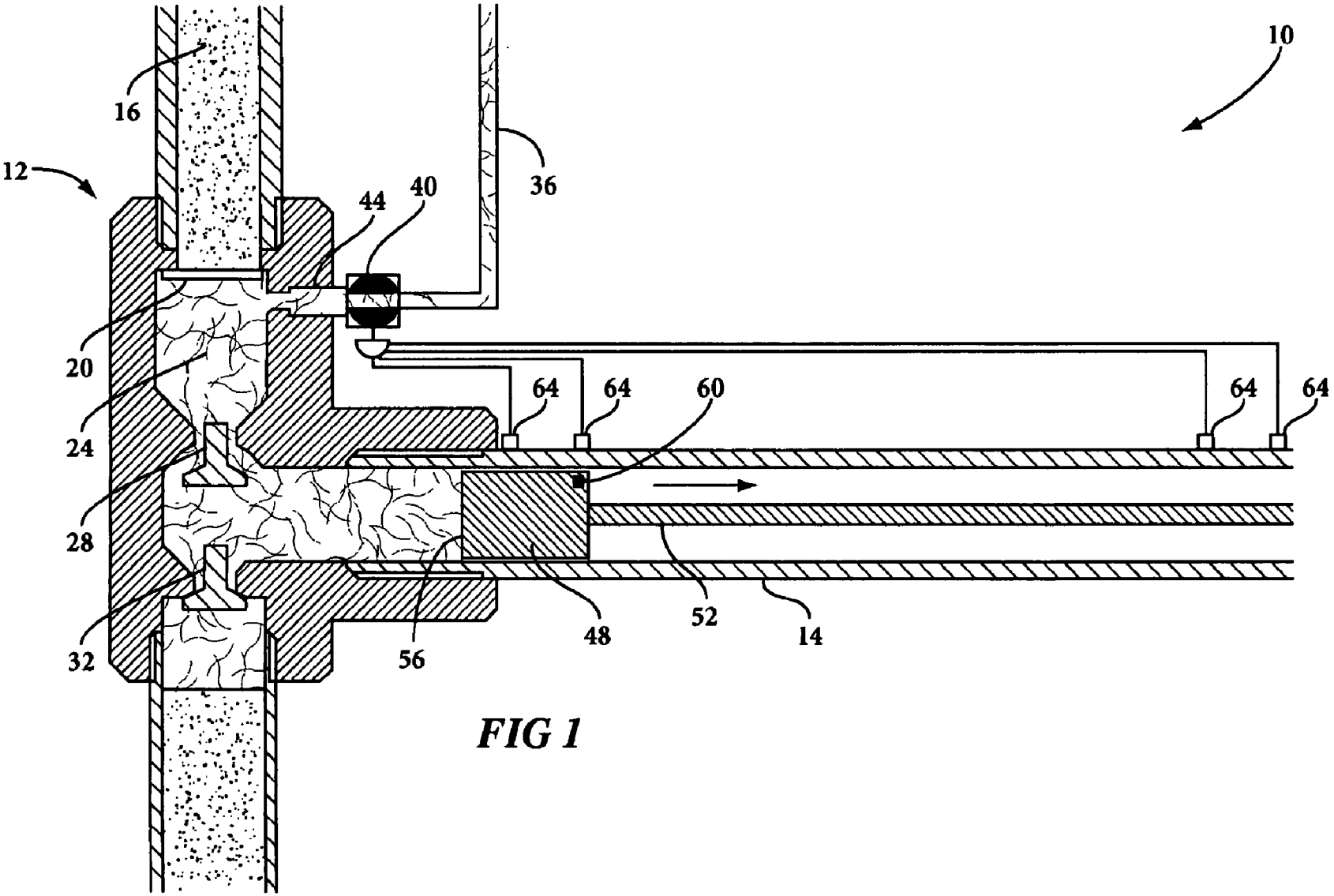
FIG. 1 is a schematic of a configuration of the high-pressure slurry pump.

FIG. 1 a schematic of a configuration of the high-pressure slurry pump, shown generally as the numeral 10. A source of slurry material 16 to be pressurized and pumped is in communication with pump or slurry head 12 through valve 20. Slurry material 16 is composed of a solid material and a slurry carrier fluid. Valve 20 can be a number of types of valves. A preferred type is a spring activated flapper valve. The pump head, shown generally as the numeral 12, incorporates an inlet chamber 24, an intake valve 28, an exhaust valve 32, and a control valve 40, which controls the flow of a supply of clean fluid 36. The clean fluid is provided at a higher pressure than that of the slurry material 16.

Connected at pump head 12 is an elongated piston cylinder 14 providing a path for a driving piston 48, which moves in a reciprocating fashion to provide the pressurizing and pumping action on the slurry material.

Piston 48 can be free-floating (hydraulic or magnetic) or a power rod as shown by rod 52 can provide the driving force. Any of these can be considered as a means for driving piston 48 through an intake and exhaust stroke cycle. A power rod such as 52 can be connected to the piston 48 from either the pressure side face 56 of the piston or connected as shown in FIG. 1. A preferred power rod configuration is the one shown in FIG. 1. Piston 48 can also (not shown) have sweeps, seal rings and/or be coated with urethane or other tough, slick surface coatings for sealing with piston cylinder 14. For selected hydraulic pump versions, the pressure differential across the piston 48 can be very low, minimizing sealing requirements.

Figure 2:
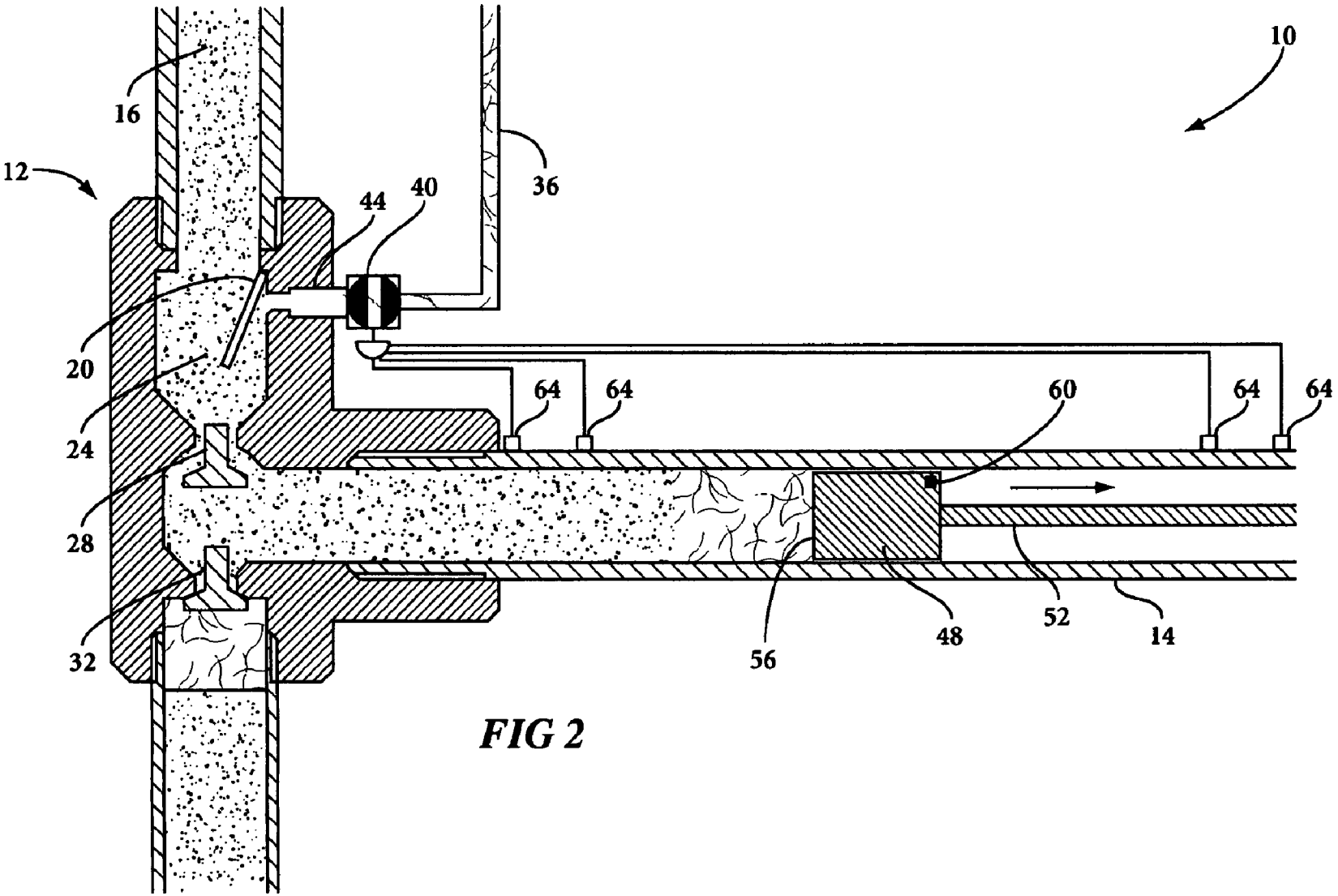
FIG. 2 is a further schematic of a configuration of the high-pressure slurry pump.
Figure 3:
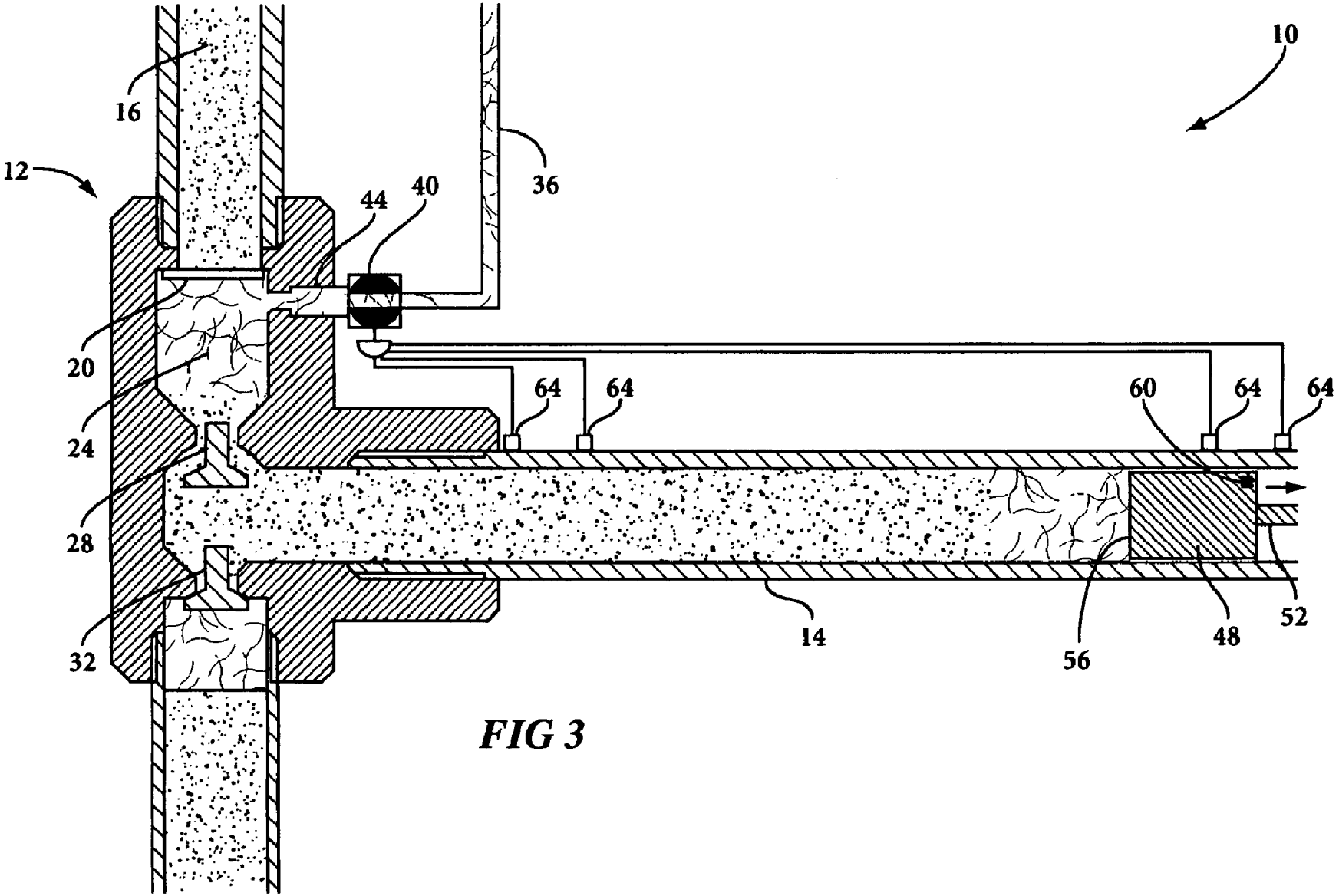
FIG. 3 is a further schematic of a configuration of the high-pressure slurry pump.

Pump action utilizing the clean flush of the instant invention is shown sequentially in FIGS. 1, 2, and 3 and described as follows: A specific volume of clean fluid is injected, via control valve 40 and channel 44 into inlet chamber 24 at the beginning and at the end of the intake stroke. FIG. 1 exhibits the beginning of the intake stroke as the piston begins to move to the right to draw material into piston cylinder 14. When clean fluid 36 is injected, spring activated flapper valve 20 closes. This allows clean fluid to be placed across the intake valve 28 when it opens. As the intake stroke cycle continues, clean fluid injection continues and a set volume is placed at the piston 'slurry side' face 56 to provide a buffer of clean fluid to keep it clear of solids on the return stroke that would impede its movement or damage the piston 48 seal with piston cylinder 14. Clean fluid injection stops at a set piston position or flush volume. As the intake stroke cycle continues, slurry now enters inlet chamber 24, through valve 20, through intake valve 28 and into piston cylinder 14. FIG. 2 shows this part of the intake stroke cycle where slurry material from 16 is now flowing through open spring activated flapper valve 20, through intake valve 28 and into piston cylinder 14. The initial volume of clean fluid is shown still protecting the front pressure face 56 of piston 48. FIG. 3 illustrates the final part of the intake stroke where control valve 40 again opens and flapper valve 20 closes, allowing clean fluid to displace slurry material through intake valve 28, clearing that valve and the pump head end 12 of erosive materials. This clean fluid allows intake valve 28 to close on clean fluid and it allows for the exhaust valve 32 to open surrounded by clean fluid in the pump or slurry head 12. The inlet chamber 24 now also contains clean fluids to reside around the intake valve 28 while it is closed. As the exhaust cycle (not shown) begins intake valve 28 closes due to pressure and piston 48 discharges a volume of pressurized clean fluid followed by all of the slurry through exhaust valve 32. At the end of the exhaust cycle, the clean fluid injected earlier still buffers the piston face 56 and surrounds the exhaust valve 32 during its closing stroke with sufficient clean fluid into the exhaust.

An alternative method of using the clean fluid injection technique is to also inject some clean fluid in the middle of the intake stroke to provide clean fluids traveling through intake valve 28 and exhaust valve 32 during the maximum flow periods seen in crank powered pumps.

In the instant invention slurry pump, as shown in FIGS. 1, 2, and 3, the entry of clean fluid to displace the slurry mixture is controlled by valve 40. This clean fluid control valve 40 is responsive to sensors 64 that monitor the position of piston 48 in cylinder 14. With valve 40 open, the clean fluid flows through channel 44, into inlet chamber 24 ahead of intake valve 28 and then on into the piston cylinder 14 at specified points in the stroke cycle. Valves 28 & 32 are typically flute or flapper valves, but can be of any type. The control, timing (on/off) and injected volume (length of time on), of this clean fluid injection/replacement is by one or more transmitters 60 on the piston 48 and sensors 64 on the piston cylinder 14. In the shown position sensing method, a transmitter 60, such as a magnetic or radioactive source, is mounted in/on the piston 48 and sensors 64 to identify and react to the piston's transmitter 60 positions are mounted/installed on the outer wall of the piston cylinder 14. These sensors/instruments 64, which could be any number of types such as magnetic, mass, optical, or density sensors, then signal the clean fluid valve 40 to open and/or close. Alternate methods to control clean fluid entry are for position sensors/instruments installed on a connecting rod or on the crankshaft or cam, if these exist on a given model that relates piston 48 position within the piston cylinder 14. Slurry valve 20, upstream of inlet chamber 24 is optional and only helps separate slurry from the clean fluid buffer and prevent dilution of the slurry circulation system.

As an alternate embodiment, control valve 40 and channel 44 could inject clean fluids directly into pump head 12, or cylinder 14 which are downstream of the intake valve 28.

This would provide a buffering clean fluid into the immediate vicinity of both the intake valve 28 and the exhaust valve 32.

As an additional embodiment of the controlled addition of clean fluid, control valve 40 could as an alternative not be controlled by the sensors described above but operate as a mechanically controlled valve operated to deliver prescribed amounts of clean fluid during the stroke cycles.

Piston 48 sticking and seal wear will be mostly due to movement under pressure over rough slurry particles trapped in front of piston 48 advancement at piston cylinder 14 wall.

Figure 4:
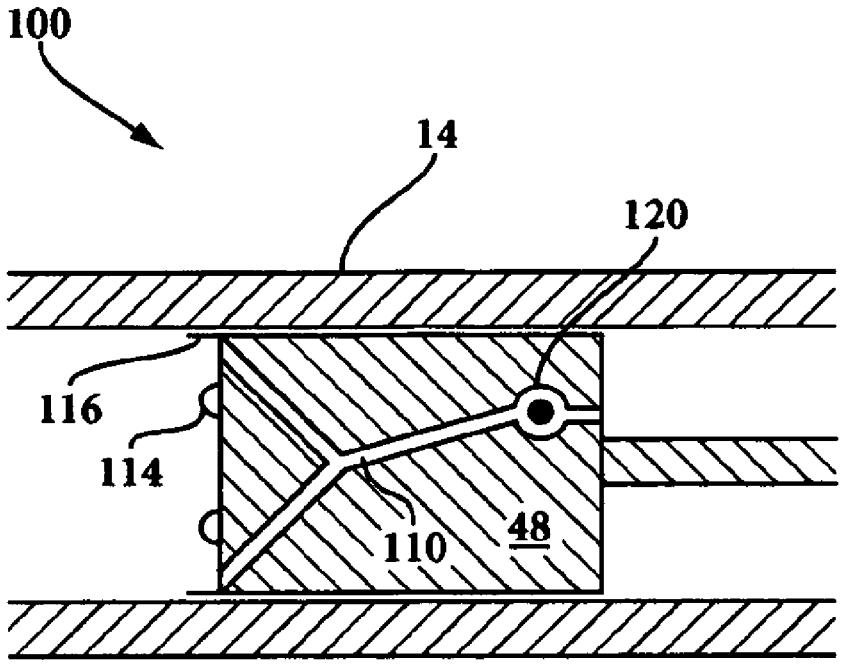
FIG. 4 is a depiction of the internal flushing channels of the piston of the high-pressure slurry pump.

FIG. 4 shows an option to keep slurry solids from settling on the cylinder walls and sticking piston 48. In this option, piston 48 can have internal channels 110 from a clean source (such as the clean power side in a hydraulic version or the same clean flush fluid described earlier) to the slurry side with a one-way check valve 120 controlling flow direction. Such channels direct the higher pressured clean fluid to the front outside edges of the piston on the slurry side. A nozzle or choke may be installed in the internal channel 110 to control the flow rate for a given pressure differential. Also, piston 48 can have scrapers or knives 116 on the slurry side face edge to scrape off solids of cylinder wall ahead of the piston.

Figure 5:
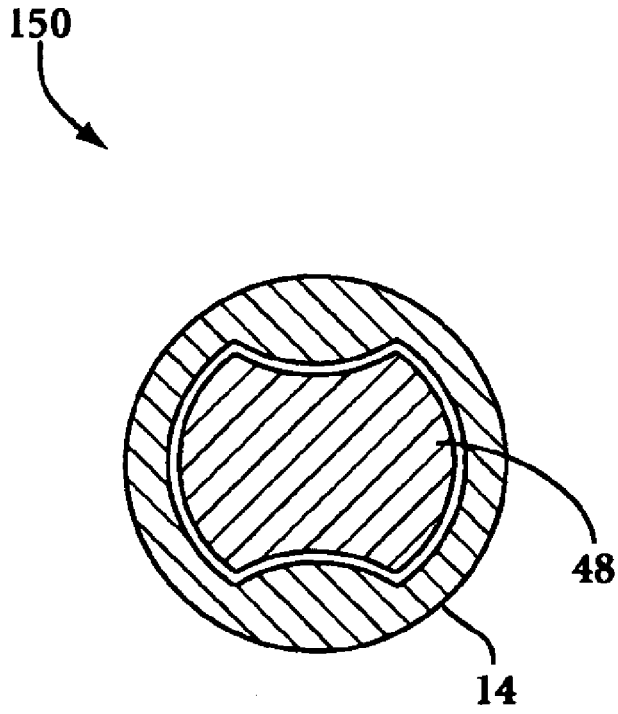
FIG. 5 is depiction of an internal helical pattern of the piston cylinder and piston.

In FIG. 1 the internal surface of piston cylinder 14 is shown as smooth. In FIG. 5, to aid in keeping the slurry mixed during the stroke cycle, an optional internal surface of the piston cylinder 14 is shown in cross section that has a helical (single, double or more) spiral path. For this option, a plunger/piston 48 with an outer surface that matches the piston cylinder pattern is required. Also note that piston 48 must now rotate in piston cylinder 14 as it strokes. In this version, the piston 48 can also have paddles or fins 114 (in FIG. 4) on the slurry side face to keep the solids and fluids moving and away from the cylinder wall.

Figure 6:
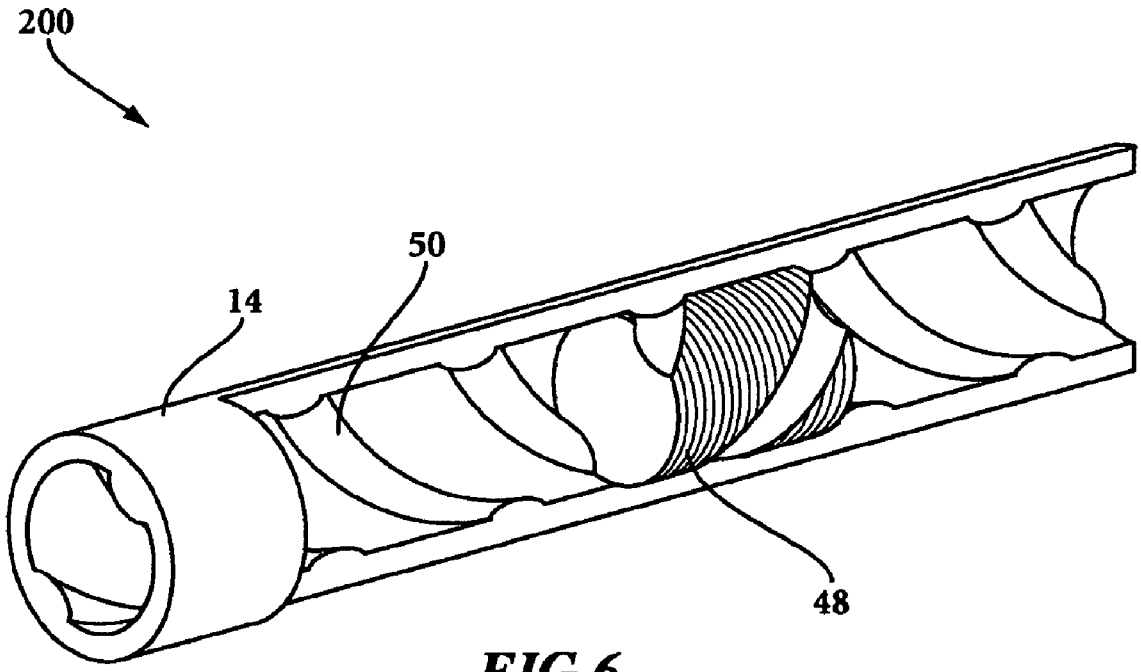
FIG. 6 is a longitudinal depiction of an internal helical pattern of the piston cylinder.

FIG. 6 is a longitudinal view, shown generally by the numeral 200, of the embodiment of FIG. 5. The piston cylinder 14 in this view shows an internal surface with a helical spiral path 50. Piston 48 has an outer surface that matches the piston cylinder pattern. The resulting rotation of piston 48 helps keep the slurry mixed during the stroke cycle.

An alternate means (not shown) of rotating the piston and maintaining mixing of the slurry is by incorporating a centralized rod through the piston cylinder that has a helical (single, double or more spirals) surface pattern. This can be with any internal piston cylinder surface design, smooth or helical spiral. The piston must now have an internal helical bore to match the rod pattern and have matching seals.

A viscous clean fluid stream, that is at least twice as viscous as the slurry carrier fluid, would make the overall flushing performance more efficient by better clearing and suspending of solids out of the way of the valves 28 and 32 and piston 48 movement. Therefore, less buffer volume is needed of a viscous clean fluid than a thinner clean fluid resulting in more slurry pumped.

Multiple pumps in coordination (electronic, mechanical or connecting rod) are required for continuous slurry pumping, to provide a more uniform slurry density, and/or to increase the overall pumping rate over a given design. Although not shown, two slurry pumps of the design of the instant invention can be connected with a common means to drive both pistons to allow continuous, non-interrupted slurry pumping.

Slurries using liquid carbon dioxide as the carrier fluid can also be pumped with the proposed pumping assembly if the full pump assembly system is held above the critical pressure. The downstream system pressure must be pre-charged/pressurized to above the critical pressure before switching to the liquid $CO_2$, or it will flash to gas in the pump, which is undesirable. Also, a backpressure valve positioned downstream of the pump's exhaust valve could maintain a sufficient backpressure to prevent gas flashing within the pump. Use of liquid $CO_2$ for the slurry carrier fluid and the clean flush/buffer fluid would allow for a completely dry and non-combustible abrasive jetting system. Use of other flush fluids, such as water or alcohols and similar products, is also possible.

While one (or more) embodiment(s) of this invention has (have) been illustrated in the accompanying drawings and described above, it will be evident to those skilled in the art that changes and modifications may be made therein without departing from the essence of this invention. All such modifications or variations are believed to be within the sphere and scope of the invention as defined by the claims appended hereto.

The invention claimed is:

1. A slurry pump assembly comprising:

a. an inlet chamber connected to a slurry supply;

b. an intake valve, downstream of said inlet chamber, for admitting material into a piston cylinder;

c. a control valve, connected to a clean fluid supply, configured to supply clean fluid into said inlet chamber;

d. a piston in said piston cylinder for providing pressure;

e. a means for driving said piston through an intake and exhaust stroke cycle; and f. an exhaust valve connected to said piston cylinder; for exhausting pressurized materials from said piston cylinder.

2. The slurry pump assembly of claim 1 further comprising a slurry valve between said slurry supply and said inlet chamber.

3. The slurry pump assembly of claim 2 wherein said slurry valve is a spring activated flapper valve.

4. The slurry pump assembly of claim 1 further comprising:

a. a transmitter in said piston for emitting a signal;

b. at least one sensor for detecting said signal as said piston passes;

and wherein said control valve is responsive to signals from said at least one sensor.

5. The slurry pump assembly of claim 1 further comprising:

a. at least one optical sensor for detecting said piston as it passes;

and wherein said control valve is responsive to signals from said at least one optical sensor.

6. The slurry pump assembly of claim 4 wherein said at least one sensor is selected from the group consisting of magnetic sensors, mass sensors, and density sensors.

7. The slurry pump assembly of claim 1 wherein said piston contains internal channels to provide clean fluid to outside edges of a pressure side face of said piston.

8. The slurry pump assembly of claim 1 wherein said piston has mounted scrapers on a pressure side face positioned to scrape walls of said piston cylinder.

9. The slurry pump assembly of claim 1 wherein an internal surface of said piston cylinder has a helical spiral path and said piston has an outer surface that matches said helical spiral path.

10. A multiple slurry pump assembly comprising two slurry pump assemblies as described in claim 1 with one common means for driving both pistons.

11. A slurry pump assembly comprising:

a. an inlet chamber connected to a slurry supply;

b. an intake valve, downstream of said inlet chamber, for admitting material into a piston cylinder;

c. a piston in said piston cylinder for providing pressure;

d. a means for driving said piston through an intake and exhaust stroke cycle;

e. an exhaust valve connected to said piston cylinder; for exhausting pressurized materials from said piston cylinder; and f. a control valve, connected to a clean fluid supply, configured to supply clean fluid into the immediate vicinity of said intake valve and said exhaust valve.

12. The slurry pump assembly of claim 11 further comprising:

a. a transmitter in said piston for emitting a signal;

b. at least one sensor for detecting said signal as said piston passes;

and wherein said control valve is responsive to signals from said at least one sensor.

13. The slurry pump assembly of claim 11 further comprising:

a. at least one optical sensor for detecting said piston as it passes;

and wherein said control valve is responsive to signals from said at least one optical sensor.

14. The slurry pump assembly of claim 12 wherein said at least one sensor is selected from the group consisting of magnetic sensors, mass sensors, and density sensors.

15. The slurry pump assembly of claim 11 wherein said piston contains internal channels to provide clean fluid to outside edges of a pressure side face of said piston.

16. The slurry pump assembly of claim 11 wherein an internal surface of said piston cylinder has a helical spiral path and said piston has an outer surface that matches said helical spiral path.

17. A multiple slurry pump assembly comprising two slurry pump assemblies as described in claim 11 with one common means for driving both pistons.

18. A method to displace slurry material and place clean fluid across the intake and exhaust valves during the stroke cycles of a slurry piston pump assembly comprising the steps of:

a. injecting a first specific volume of a clean fluid into the immediate vicinity of said intake and exhaust valves as a piston is initially withdrawn from a piston cylinder during a first portion of an intake stroke cycle, allowing clean fluid to buffer said intake and exhaust valves;

b. flowing a slurry consisting of a solid material and a slurry carrier fluid through said intake valve and into said piston cylinder during a second portion of said intake stroke cycle; and c. injecting a second specific volume of clean fluid into the immediate vicinity of said intake and exhaust valves as said piston is withdrawn from said piston cylinder during a third and final portion of said intake stroke cycle, allowing clean fluid to buffer said intake and exhaust valves.

19. The method of claim 18 wherein said slurry carrier fluid is liquid carbon dioxide and said clean fluid is selected from the group consisting of liquid carbon dioxide, water, alcohol, or another volatile liquid; and wherein the pump assembly pressures are maintained above the critical pressure for carbon dioxide.

20. The method of claim 18 wherein said clean fluid is at least twice as viscous as said slurry carrier fluid.

* * * * *